US005951348A

United States Patent [19]

Liong et al.

[11] Patent Number: 5,951,348

[45] Date of Patent: Sep. 14, 1999

[54] LIFE PRESERVER FOR AN INFANT OR YOUNG CHILD

[75] Inventors: Dennis Liong, Parkland; Maria I. Isbell, Miami, both of Fla.

[73] Assignee: Hoover Industries, Inc., Miami, Fla.

[21] Appl. No.: 09/083,070

[22] Filed: May 21, 1998

[51] Int. Cl.[6] ..... B63C 9/08

[52] U.S. Cl. ..... 441/89; 441/108; 441/131

[58] Field of Search ..... 441/80, 89, 102, 441/103, 106, 108, 109, 114, 117, 120, 129, 130, 131

[56] References Cited

U.S. PATENT DOCUMENTS

| | | | |
|---|---|---|---|
| 1,619 | 5/1840 | Porter . | |
| 2,051,281 | 8/1936 | Webber | 441/131 |
| 2,724,843 | 11/1955 | Kimball | 441/131 |
| 3,050,752 | 8/1962 | Birchall | 441/102 |
| 4,052,762 | 10/1977 | Zawislak | 441/102 |
| 4,687,452 | 8/1987 | Hull | 441/131 |
| 5,766,052 | 6/1998 | Metro et al. | 441/131 |

*Primary Examiner*—Stephen Avila
*Attorney, Agent, or Firm*—Robert C. Kain, Jr.

[57] ABSTRACT

The life preserver for an infant or young child includes a pair a vertically stacked, peripherally disposed, inflatable tubes. A life vest is sized to enclose the torso of the infant or young child. The life vest is attached at a plurality of locations to the interior or inboard region of one of the vertically stacked, peripheral tubes. Preferably, the life vest is attached to the tube via short straps such that the vest can move with respect to the inflated or deflated tubes. A seat for the infant or young child is attached at a plurality of locations to the interior of one of the vertically stacked peripheral tubes. Preferably, the seat is attached at a forward and an aft region to the top tube. The life preserver also includes a drag bag attached at a plurality of locations to the interior of one of the vertically stacked, peripheral tubes. The drag bag acts as a ballast for the loaded and deployed life preserver. Preferably, the drag bag is attached via straps to the tubes such that the bag can move with respect to the tubes in an inflated or a deflated mode.

24 Claims, 5 Drawing Sheets

LIFE PRESERVER FOR AN INFANT OR YOUNG CHILD

BACKGROUND OF THE INVENTION

U.S. Pat. No. 1,619 by R. Porter, patented May 25, 1840, discloses a life preserver having a plurality of vertically stacked, peripherally disposed, inflatable tubes attached about the hip region of a pair of pants. Straps are attached to the top edge of the pants and presumably extend over the shoulders of a user.

OBJECTS OF THE INVENTION

It is an object of the present invention to provide an infant or young child life preserver that is anthropomorphically designed to buoyantly support the child in water.

It is another object of the present invention to provide a life preserver which utilizes a ballast drag bag in order to counter-balance the normally "top heavy" infant or young child.

It is an additional object of the present invention to provide a life preserver for an infant or a young child which provides limited hypothermia protection for the child.

It is a further object ofthe present invention to provide a life preserver which includes a torso vest having a curved top region which limits rearward movement of the head of the infant or child when the life preserver is in an inflated and buoyant mode.

It is an additional object of the present invention to provide a life preserver with a pair of vertically stacked, peripherally disposed, inflatable tubes in order to provide redundancy and safety for the infant or child.

It is an additional object of the present invention to provide a pair of vertically stacked, peripherally disposed, inflatable tubes in order to raise the child or infant's body a significant distance above the water line.

SUMMARY OF THE INVENTION

The life preserver for an infant or young child includes a pair a vertically stacked, peripherally disposed, inflatable tubes. A life vest is sized to enclose the torso of the infant or young child. The life vest is attached at a plurality of locations to the interior or inboard region of one of the vertically stacked, peripheral tubes. Preferably, the life vest is attached to the tube via short straps such that the vest can move with respect to the inflated or deflated tubes. A seat for the infant or young child is attached at a plurality of locations to the interior of one of the vertically stacked peripheral tubes. Preferably, the seat is attached at a forward and an aft region to the top tube. The life preserver also includes a drag bag attached at a plurality of locations to the interior of one of the vertically stacked, peripheral tubes. The drag bag acts as a ballast for the loaded and deployed life preserver. Preferably, the drag bag is attached via straps to the tubes such that the bag can move with respect to the tubes in an inflated or a deflated mode.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a life preserver for an infant or a young child.

Figure 5:
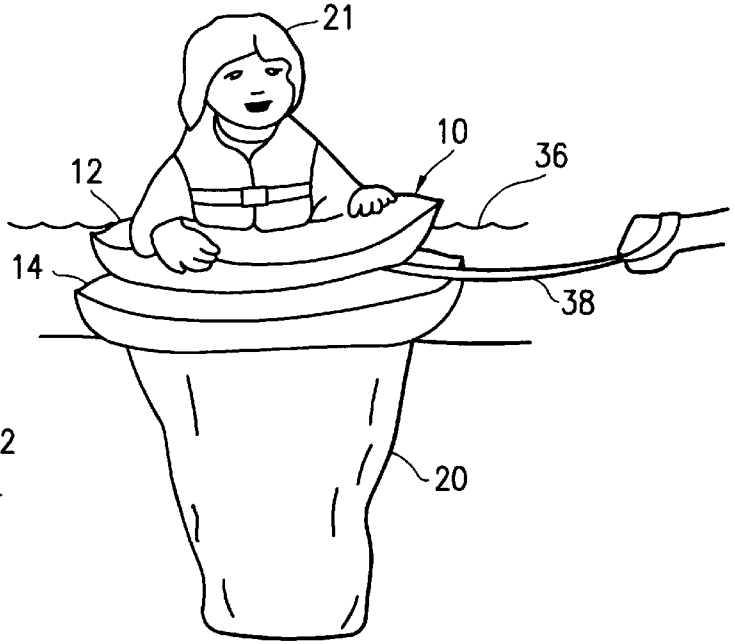
FIG. 5 diagrammatically illustrates the infant or young child buoyantly supported by the life preserver.

FIGS. 1–4 diagrammatically illustrate the manner in which an infant or a young child (herein collectively referred to as "the child") is strapped into the life preserver. FIG. 5 diagrammatically illustrates the child strapped into an inflated life preserver when the preserver buoyantly supports the child in water. It should be noted that the life preserver of the present invention is utilized on aircraft. Accordingly, in a deflated state, the entire life preserver occupies a compact volume of space (approximately less than 6 inches by 6 inches by 3 inches). Further, the life preserver is designed to be quite light, that is, approximately 2.2 lbs. In the airline industry, compact, light components are critical to the success and profitability of the airline. Further, the present invention is anthropomorphically designed to buoyantly carry a child up to approximately 35 lbs. Above that weight (or approximate weight), the child may utilize an adult life preserver.

One of the problems solved by the present invention is that children of this size are generally "top heavy." Further, it is necessary to buoyantly support the child at a level above the water which is generally higher than an adult carried by a life preserver in water. It should be appreciated that in an emergency situation, the child is placed under significant stress. Adults and teenagers may be buoyantly supported by a common life preserver or life vest as long as their heads are supported above the level of water. In contrast, an infant or young child should be supported at a higher level above the water level in order to reduce anxiety and stress. This "height above water level" issue resulted in the utilization of a dual tube flotation system and a drag bag that acts as a ballast for the life preserver system. In a preferred embodiment, the height of the drag bag or ballast is approximately 36 inches and the outer dimension of the peripherally disposed, inflatable tubes is approximately 22 inches. The claims appended hereto are not meant to be limited by the dimensions utilized in a working embodiment of the present invention.

It should be noted that it is difficult to illustrate the various components of the life preserver in accordance with the principals of the present invention because in a deflated mode, the tubes, child life vest and drag bag are very "floppy" and do not retain any significant shape. Accordingly, many of the figures (FIGS. 8–20) diagrammatically illustrate various aspects of the life preserver in an inflatable mode and when the drag bag is fully extended or acting as a ballast. These are diagrammatic illustrations which show various features of the present invention. Notwithstanding these diagrammatic illustrations, it is important to note that the present invention in a deflated state is very compact and is very light.

Figure 1:
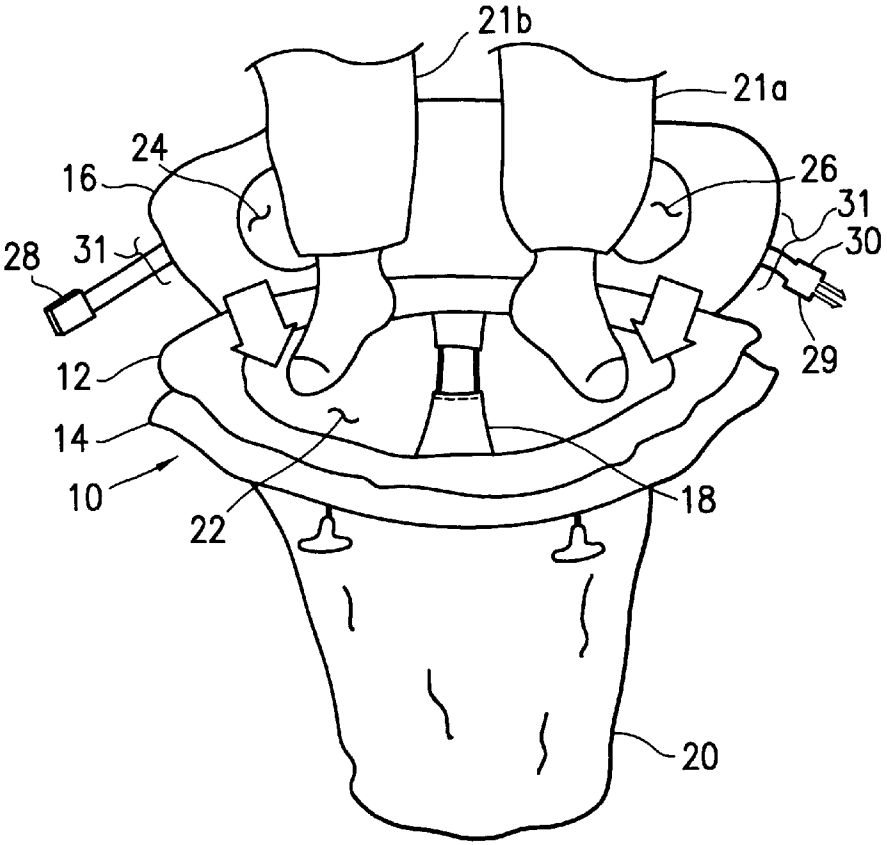

FIGS. 1–4 diagrammatically illustrate the manner in which the infant or young child is placed into the life preserver when the life preserver is in a deflated mode. The major components of life preserver 10 include upper and lower vertically stacked, peripherally disposed, inflatable tubes 12–14, a life vest 16 sized to enclose the torso of an infant or young child, a seat 18 upon which the child sits, and a drag bag 20. In FIG. 1, the life preserver is opened up, the drag bag is opened to expose open top 22 and the legs 21*a*, 21*b* of child 21 are placed in bag 20. The child's legs 21*a*, 21*b* straddle seat 18.

Vest 16 is sized to enclose the torso of child 21 and includes arm holes 24, 26 and buckle system 28, 30 extending from a reinforced medial region 31 of life vest 16. Arms 27*a*, 27*b* of child 21 are placed through the arm holes of vest 16.

Figure 2:
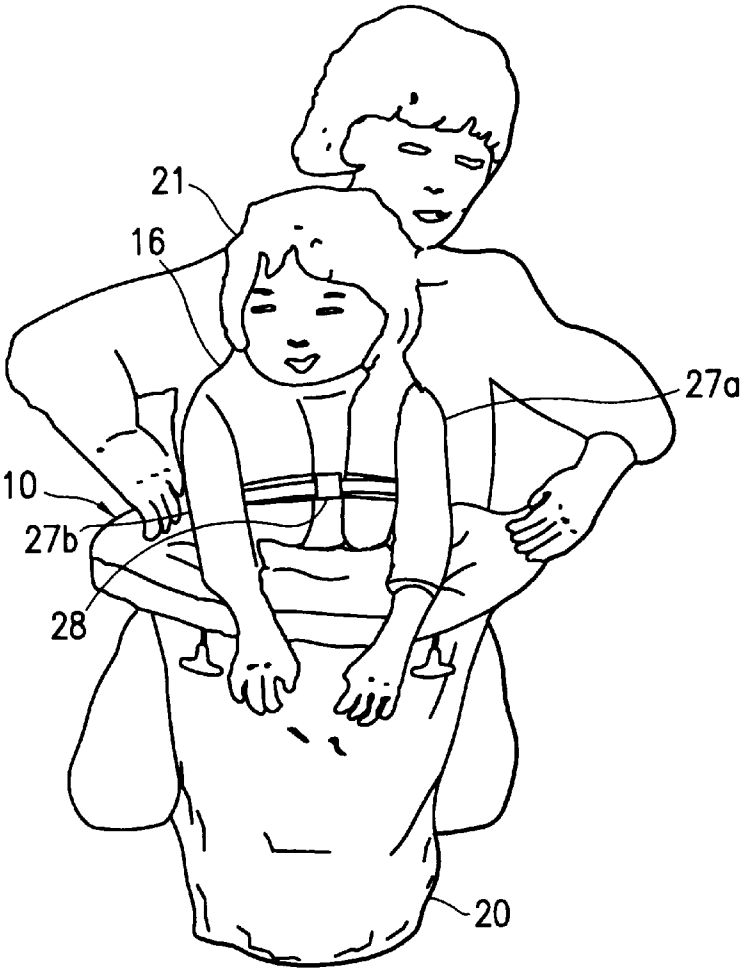
FIGS. 1–4 diagrammatically illustrate the manner in which the infant or young child is placed in the life preserver.

FIG. 2 diagrammatically shows vest 16 strapped to the torso of child 21 and the buckle system 28, 30 in a closed mode wherein female buckle 28 is latched onto male tongues or clips 29 of male buckle segment 30.

Figure 3:
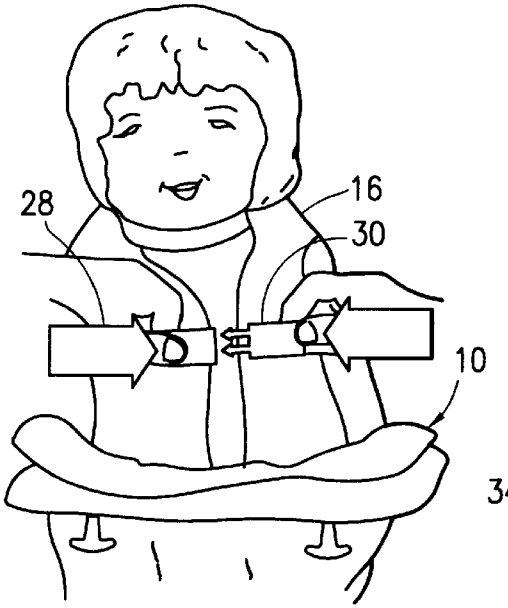

FIG. 3 diagrammatically shows male buckle 30 with female buckle 28 on life vest 16.

Figure 4:
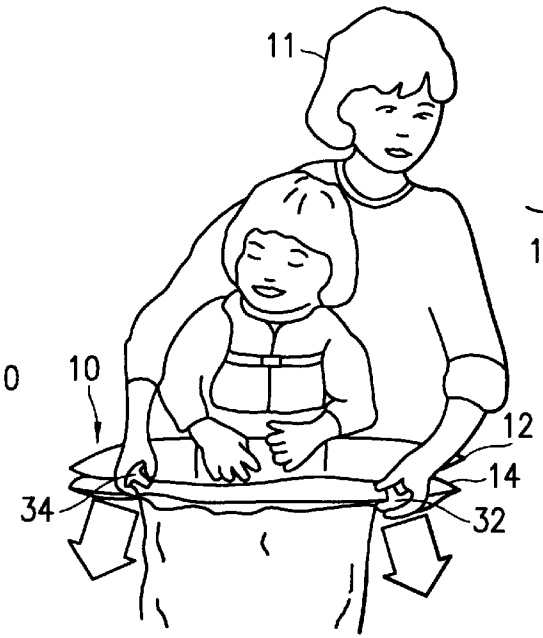

In FIG. 4, adult 11 pulls on inflation canister tab controls 32, 34 thereby opening valves leading to a sealed gas container in order to inflate upper and lower tubes 12, 14 of life preserver 10. These gas canisters (one for each inflatable tube) commonly hold compressed carbon dioxide. These canisters are customarily used on other life preserver systems, particularly adult life preserver systems utilized by the airline industry.

FIG. 5 diagrammatically illustrates child 21 buoyantly supported by life preserver 10 above water line 36. A tether 38 enables the loaded infant or young child life preserver 10 to be towed or attached to a raft or other type of life preserver or emergency development system. In FIG. 5, drag bag is partially or fully filled with water in order to provide ballast for the activated and loaded life preserver 10. As is shown in FIG. 5, child 21 floats very high above water line 36. This feature is difficult to achieve in the absence ofthe present invention. Vertically stacked, peripherally disposed, inflatable tubes 12, 14 enable the child to float high above water level 36. In addition, two tubes are utilized in order to provide some redundancy for this emergency life preserver system.

Similar numerals designate similar items throughout all the drawings.

Figure 6:
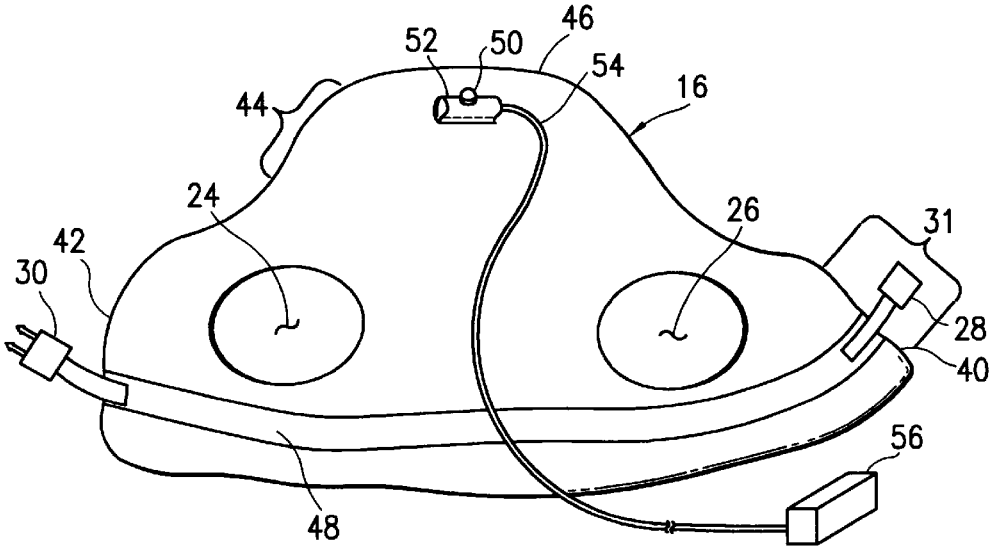
FIG. 6 diagrammatically illustrates the life vest portion of the life preserver.

FIG. 6 diagrammatically illustrates life vest 16. Life vest 16 includes arm holes 24, 26 and is sized to enclose the torso of child 21. Life vest 16 includes buckle system 28, 30 attached along edges 40, 42 and disposed at a reinforced medial region 31 of life vest 16. An upper region 44 of life vest 16 includes a curved neck portion 46. Curved neck portion 46 limits the rearward movement of the head of child 21 when the vest is on the child. In order to enhance the security and stability of vest 16, a strap or ribbon 48 is also attached to a reinforced medial region 31.

A light 50 is attached to a cloth loop 52 at upper region 44 of life vest 16. A power cord 54 is electrically connected to light 50 and to water activated battery 56. When battery 56 falls in the water, a voltage differential is made available and light 50 is turned ON.

Figure 7:
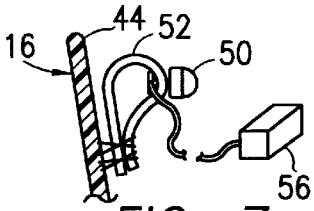
FIG. 7 diagrammatically illustrates the water activated light.

FIG. 7 diagrammatically shows a cross section of vest 16 and particularly upper region 44, cloth loop 52, light 50 and water activated battery 56. Attachment point and method of attachment of battery and light is not significant as long as battery is submerged when vest is fully inflated and light is visible and not obscured by other parts.

Figure 8:
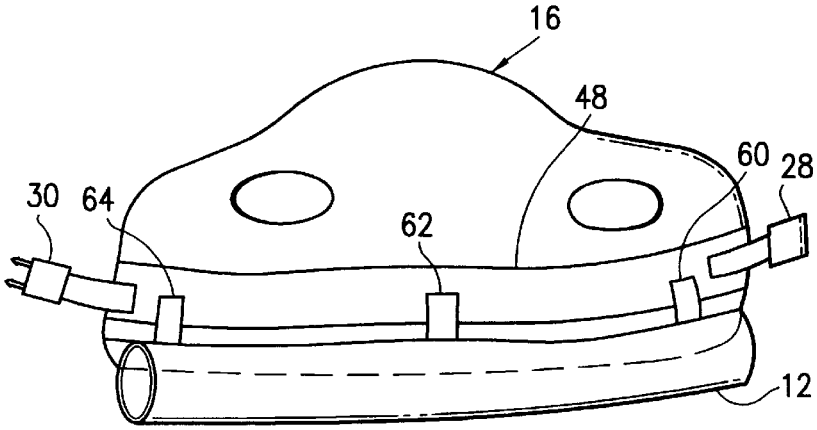
FIGS. 8-9 diagrammatically illustrate the strap attachments between the life vest and one of the inflatable tubes.

FIG. 8 diagrammatically illustrates how life vest 16 is attached to upper tube 12. In order to provide some spacing and freedom of movement between life vest 16 and the inflated tubes as well as the deflated tubes, life vest 16 is attached at a plurality of locations to top tube 12. Preferably, vest 16 is attached at three locations to tube 12 via vest straps or strips 60, 62 and 64. Vest strips or straps 60, 62, 64 are made of cloth, nylon or other type of durable material and are sewn or attached by glue or heat fusion to support strip 48 on the back side of vest 16.

Figure 9:
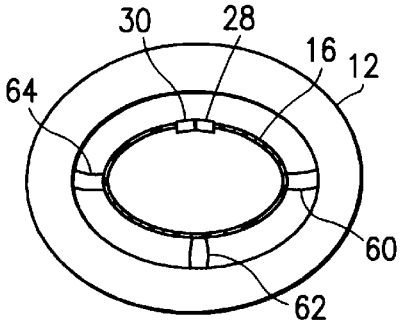

FIG. 9 diagrammatically illustrates the triad attachment of life vest 16 to upper tube 12 via strips or straps 60, 62 and 64. It should be noted that vest attachment straps 60, 64 are opposite each other and vest attachment strap 62 is opposite buckle system 28, 30. This distributes the weight of the child around tube 12 and also permits maximum movement of the child in the life preserver when the child is being placed in the preserver as well as after the preserver has been inflated and the child and loaded preserver is placed in the water.

It is important to note that although round tubes 12, 14 are illustrated herein, other shapes may be utilized. Tubes shaped as ellipsoids, squares, rectangles triangles and other shapes may be utilized.

Figure 10:
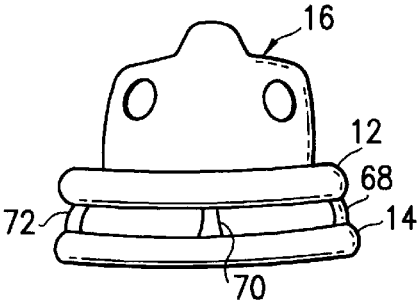
FIG. 10 diagrammatically illustrates the attachment ofthe two vertically stacked, peripherally disposed inflatable tubes.

FIG. 10 diagrammatically illustrates the attachment of lower tube 14 to upper tube 12. This attachment is created by tube straps or strips 68, 70, 72. By utilizing spacing strips or straps 68, 70, 72, there is additional freedom of movement between upper tube 12 and lower tube 14. Further, this freedom of movement tends to compensate for shifting loads if the child moves to one side of the life preserver. When the child moves to one side, the upper tube would move to the opposite side but because of the tube straps 68, 70, 72, the lower tube would move to the side where the child is shifting his or her weight. This feature of the present invention enhances the stability of the life preserver.

Figure 11:
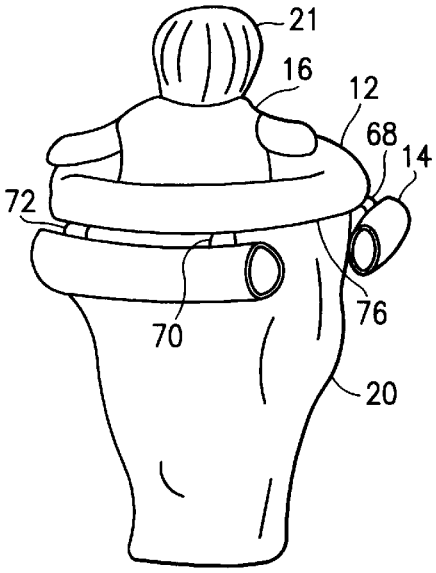
FIG. 11 diagrammatically illustrates the attachment of the tubes with the infant or child disposed in the life preserver.

FIG. 11 diagrammatically illustrates the triad connection of tube straps 68, 70, 72 and the attachment of drag bag 20 to upper tube 12. Lower tube 14 is cut away to show that drag bag 20 is attached to the lower region 76 of upper tube 12.

Figure 12:
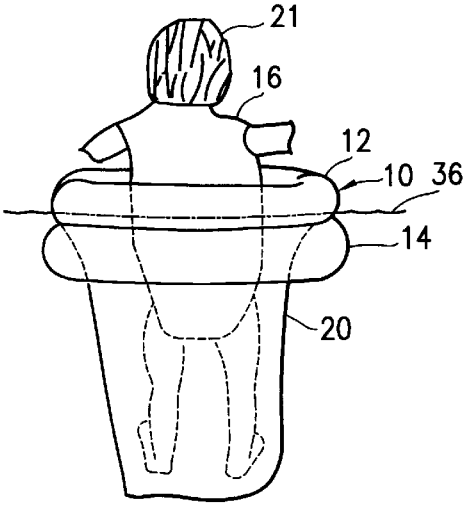
FIG. 12 diagrammatically illustrates a loaded life preserver and the ballast drag bag.

In FIG. 12, the life preserver 10 buoyantly supports torso of child 21 above water level 36. Drag bag 20 is completely filled with water as shown by the dash-dot-dashed line in FIG. 12.

Drag bag 20, when filled or partially filled with water, acts as ballast to keep life preserver 10 and child 21 upright and to counter balance the "top heavy" body weight of child 21.

Further, when drag bag 20 is partially or completely filled with water, the water trapped in the bag is heated by the legs and lower torso of child 21. This heated water remains trapped in the bag and eliminates or reduces hypothermia in child 21. In order to introduce water into the interior of bag 20, bag 20 is either made of porous material, has open seams, has a plurality of holes (FIG. 13*a*, hole 77), has one or more holes 79 in the seam region (FIG. 13*b*), or has a plurality of very small perforations therethrough to permit the passage of water from the exterior to the interior of drag bag 20. Alternatively, water may spill into drag bag 20 by overspill over the vertically stacked tubes. This overspill of water is shown by arrow 80 in FIG. 17.

Figure 13A:
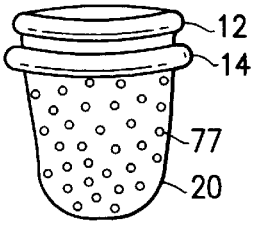
FIGS. 13*a*–13*c* diagrammatically illustrate various configurations to establish a porous drag bag.
Figure 13B:
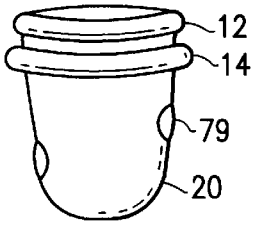
Figure 13C:
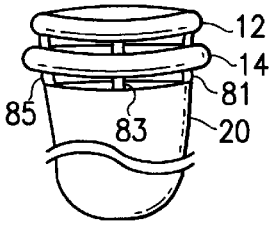

FIG. 13*c* diagrammatically shows an alternate embodiment wherein drag bag 20 is attached via bag straps 81, 83 and 85 to lower tube 14. Lower tube 14 is attached via tube straps to upper tube 12. In this configuration, water easily spills over into the interior of drag bag 20.

Figure 14:
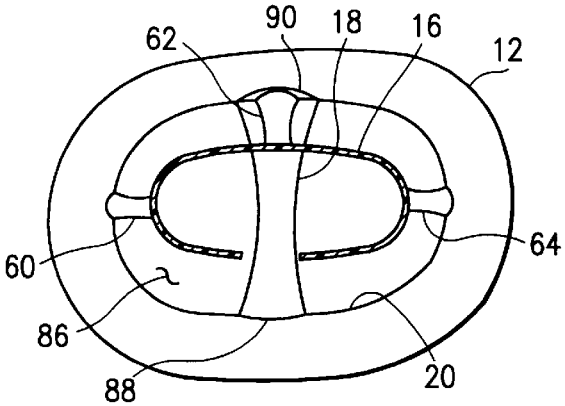
FIGS. 14–16 diagrammatically illustrate the attachment of the seat to one of the vertically stacked, peripheral tubes.
Figure 15:
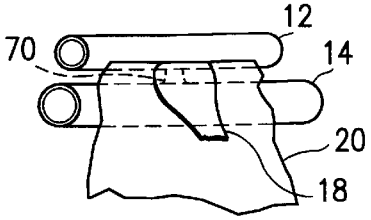
Figure 16:
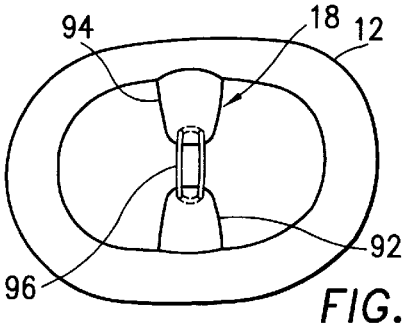

FIGS. 14–16 diagrammatically illustrate seat 18. In FIG. 14, vest 16, shown in cross section, is supported via vest straps 60, 62 and 64. A seat 18 hangs within the interior 86 of drag bag 20. Seat 18 is attached to upper tube 12 at position 88 and 90. As shown in FIG. 15, seat 18 is attached to the lower edge of tube 12. Bag 20 is also attached the lower edge of tube 12. Tube strap 70 attaches upper tube 12 to lower tube 14.

FIG. 16 diagrammatically shows a seat system 18 consisting of forward portion 92 and rearward portion 94. Forward portion 92 is attached to rearward portion 94 via expandable cords 96. This seat configuration expands based upon the size of the child. Alternatively, the entire seat 18 may be made of expandable material to accommodate children of different sizes.

Figure 17:
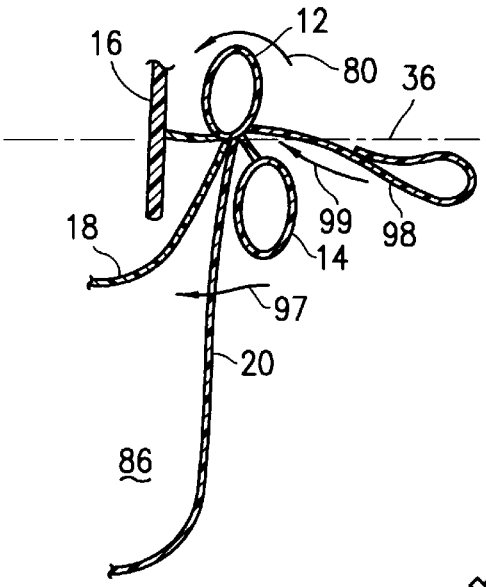
FIG. 17 diagrammatically illustrates attachment of the life vest, upper and lower inflatable tubes, back tether loop, seat and drag bag.

FIG. 17 diagrammatically illustrates upper tube 12 which is connected via a plurality of straps to lower tube 14. Generally, upper tube 12 is positioned above water line 36 whereas lower tube 14 is positioned below the water line. Vest 16 is attached to the same lower peripheral region of upper tube 12 as is seat 18, drag bag 20 and an additional, short length tether strap 98. Due to the positioning and the use of a plurality of straps to space apart the various components, water flows into the interior 86 of drag bag 20 as shown by arrow 80. Water also penetrates interior region 86 by flowing between upper and lower tubes 12, 14 as shown by arrow 99. Due to the porosity or the loose seams or holes in drag bag 20, water passes into interior space 86 as shown by arrow 97.

Figure 18:
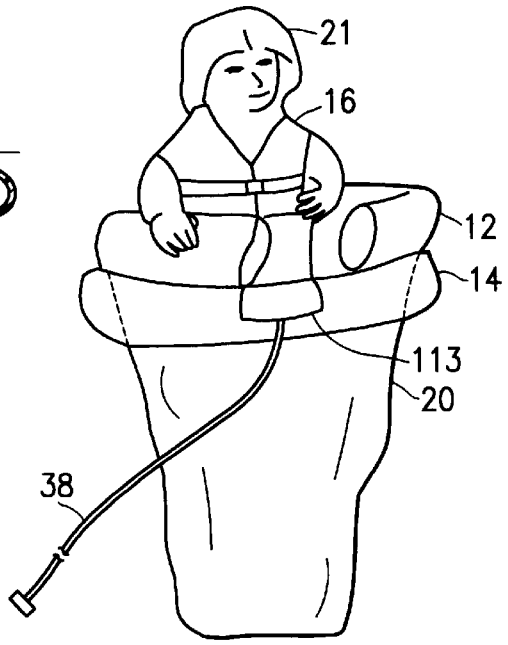
FIGS. 18-19 diagrammatically illustrate the forward cord tether attached to the front of the life preserver.

FIG. 18 diagrammatically shows that long line tether 38 is attached by patch 113 to the front side or forward region of lower tube 14.

Figure 19:
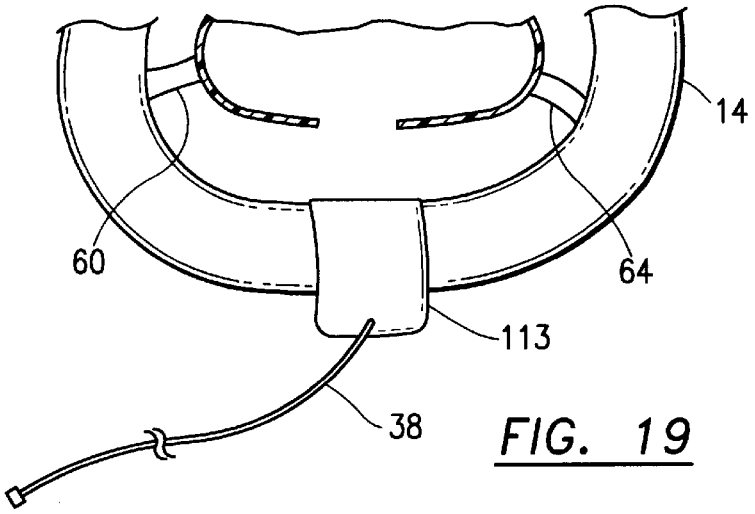

FIG. 19 shows that the forward positioning of long line tether 38 to lower tube 14 distributes the pulling force about the preserver since the vest straps 64, 60 are attached to the side of vest 16. By pulling on lower tube 14, the forces are transferred to the upper tube and also ultimately to the sides of the life vest attached to the child.

Figure 20:
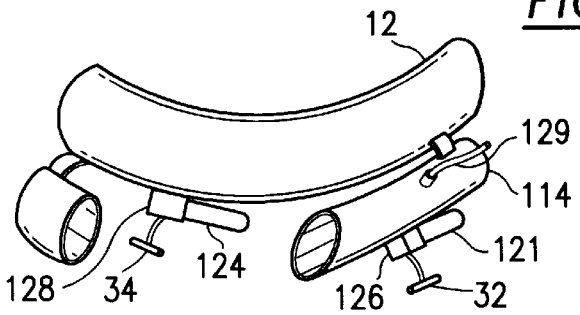
FIG. 20 diagrammatically illustrates inflation devices for the inflatable tubes (carbon dioxide canisters) and a manual inflation device.

FIG. 20 diagrammatically illustrates gas canisters 121, 124, and appropriate valves 126, 128 that are used to inflate lower tube 14 and upper tube 12. In the event the gas canisters do not inflate the tubes, a manual stem and valve system 129 is disposed on lower tube 14. A similar manual tube inflate system can be disposed on upper tube 12.

Although the invention described herein has many components attached to upper tube 12, it should be noted that the system may work equally well with the components attached to lower tube 14. Also, rather than three strap attachments between the tubes, between each one of the tubes and the vest and the bag, the present invention may utilize a plurality of attachments. In a current working embodiment, many of the attachments and materials are sewn together. However, heat fusion, adhesive or other type of attachment mechanism may be utilized. The claims appended hereto are meant to cover modifications and changes within the scope and spirit of the present invention.

What is claimed is:

1. A life preserver for an infant or young child comprising:

a pair of vertically stacked, peripherally disposed, inflatable tubes;

a life vest sized to enclose a torso of said infant or young child and attached at a plurality of locations to an interior of said vertically stacked peripheral tubes;

a seat attached at a plurality of locations to said interior of said vertically stacked peripheral tubes;

a drag bag attached at a plurality of locations to said interior of said vertically stacked peripheral tubes, said drag bag acting as a ballast for said tubes.

2. A life preserver as claimed in claim 1 wherein said pair of vertically stacked, peripherally disposed, inflatable tubes includes a top tube and a bottom tube, said top tube being attached to said bottom tube by strips which permit said top and bottom tubes to move apart.

3. A life preserver as claimed in claim 1 wherein said life vest is attached to said interior of said tubes by a plurality of strips which permit said vest to move away from said tubes.

4. A life preserver as claimed in claim 1 wherein said pair of vertically stacked, peripherally disposed, inflatable tubes includes a top tube and a bottom tube, and said seat is attached at forward and aft positions to said top tube.

5. A life preserver as claimed in claim 1 wherein said drag bag is porous.

6. A life preserver as claimed in claim 5 wherein the porosity of said drag bag is established by one from the group of a plurality of holes, a plurality of perforations, a plurality of passages and porous material.

7. A life preserver as claimed in claim 1 wherein said drag bag fills with water due to one from the group consisting of bag porosity and over splash into said bag.

8. A life preserver as claimed in claim 1 wherein said seat is disposed in an interior space in said drag bag.

9. A life preserver as claimed in claim 1 wherein said life vest is attached via straps disposed about a medial region of said vest to said interior of said vertically stacked peripheral tubes.

10. A life preserver as claimed in claim 9 wherein said life vest has vest closure straps disposed in a forward medial region of said vest.

11. A life preserver as claimed in claim 1 wherein said life vest has a water activated light.

12. A life preserver as claimed in claim 1 including a tether attached at a forward region of said vertically stacked, peripherally disposed, inflatable tubes.

13. A life preserver as claimed in claim 1 wherein said drag bag provides a thermal trap for said infant or young child.

14. A life preserver as claimed in claim 2 wherein said life vest is attached to said interior of said tubes by a plurality of vest spacer strips which permit said vest to move away from said tubes.

15. A life preserver as claimed in claim 14 wherein said seat is attached at forward and aft positions to said top tube.

16. A life preserver as claimed in claim 15 wherein said drag bag is porous.

17. A life preserver as claimed in claim 16 wherein the porosity of said drag bag is established by one from the group of consisting of a plurality of holes, a plurality of perforations, a plurality of passages and porous material.

18. A life preserver as claimed in claim 17 wherein said drag bag fills with water due to one from the group consisting of bag porosity and over splash into said bag.

19. A life preserver as claimed in claim 18 wherein said seat is disposed in an interior space in said drag bag.

20. A life preserver as claimed in claim 19 wherein said life vest is attached via vest attachment straps disposed about a medial region of said vest to said interior of said vertically stacked peripheral tubes.

21. A life preserver as claimed in claim 20 wherein said life vest has vest closure straps disposed in a forward medial region of said vest.

22. A life preserver as claimed in claim 21 wherein said life vest has a water activated light.

23. A life preserver as claimed in claim 22 including a tether attached at a forward region of said vertically stacked, peripherally disposed, inflatable tubes.

24. A life preserver as claimed in claim 23 wherein said drag bag provides a thermal trap for said infant or young child.

* * * * *